United States Patent [19]

Langner

[11] Patent Number: 4,700,788

[45] **Date of Patent: * Oct. 20, 1987**

[54] DIRECTIONAL DRILLING PIPELAY

[75] Inventor: Carl G. Langner, Spring, Tex.

[73] Assignee: Shell Oil Company, Houston, Tex.

[ * ] Notice: The portion of the term of this patent subsequent to Nov. 19, 2002 has been disclaimed.

[21] Appl. No.: 731,204

[22] Filed: May 6, 1985

[51] Int. Cl.[4] ..... E21B 7/04

[52] U.S. Cl. ..... 175/61; 175/62; 405/270

[58] Field of Search ..... 175/94, 95, 53, 61, 175/62, 73, 75; 405/270

[56] References Cited

U.S. PATENT DOCUMENTS

| | | | |
|---|---|---|---|
| Re. 28,449 | 6/1975 | Edmond | 175/94 |
| 1,388,545 | 8/1921 | Bohan | 175/94 X |
| 2,706,616 | 4/1955 | Osmun | 255/27 |
| 2,847,655 | 8/1958 | Schurman | 340/18 |
| 2,946,578 | 7/1960 | DeSmaele | 175/62 X |
| 3,260,318 | 11/1963 | Neilson et al. | 175/75 |
| 3,330,368 | 7/1967 | Baran et al. | 175/94 |
| 3,667,556 | 6/1972 | Henderson | 175/73 |
| 3,817,345 | 6/1974 | Bailey | 175/40 |
| 3,827,512 | 8/1974 | Edmond | 175/94 |
| 4,060,141 | 11/1977 | Catterfield | 175/94 |
| 4,085,808 | 4/1978 | Kling | 175/94 |
| 4,117,895 | 10/1978 | Ward et al. | 175/53 |
| 4,202,416 | 5/1980 | Blaschke et al. | 175/94 |
| 4,221,503 | 9/1980 | Cherrington | 405/184 |
| 4,245,313 | 1/1981 | Coates | 364/422 |
| 4,314,615 | 2/1982 | Sodder, Jr. et al. | 175/94 |
| 4,319,240 | 3/1982 | Stone et al. | 340/856 |
| 4,319,648 | 3/1982 | Cherrington | 175/53 |
| 4,453,603 | 6/1984 | Voss et al. | 175/53 |
| 4,553,879 | 11/1985 | Langner | 175/61 X |

FOREIGN PATENT DOCUMENTS

| | | | |
|---|---|---|---|
| 2733199 | 2/1979 | Fed. Rep. of Germany | 175/94 |

*Primary Examiner*—James A. Leppink
*Assistant Examiner*—Matthew Smith

[57] ABSTRACT

A method and apparatus are provided for constructing a deep essentially horizontal borehole in the earth, as for the installation of a pipeline in Arctic offshore waters. This directional drilling technique eliminates exposure of an Arctic offshore pipeline to ice gouging and minimizes the hazards associated with unstable permafrost. Means are provided for gripping inside a borehole in order to apply thrust to a drill bit utilized to drill the borehole which is to contain the pipeline.

13 Claims, 4 Drawing Figures

DIRECTIONAL DRILLING PIPELAY

BACKGROUND OF THE INVENTION

Drilling by the oil industry in Arctic offshore waters, typically from artificial gravel islands constructed to support such drilling activities, creates a need for pipelines from these offshore drilling sites to transport oil and gas to production facilities onshore. Conventional pipelaying techniques are extremely difficult to implement in the Arctic offshore area, due to several factors:(1) a variable shifting ice cover, which can damage floating vessels or prevent movement of such vessels during much of the year;(2) gouging of the seafloor by ice keels, which requires that pipelines be deeply buried to prevent damage; and (3) permafrost soil conditions, which can lead to pipeline failure due to loss of soil support under the pipeline. Pipeline construction from the surface of the ice during winter is treacherous and impractical, and the open water construction season in summer is both short and unpredictable.

Applicant is not aware of any prior art which, in his judgment as one skilled in the pipeline art, would anticipate or render obvious the novel pipeline construction technique of the present invention; however, for the purposes of fully developing the background of the invention and establishing the state of the requisite art, the following is set forth and incorporated hereinto: U.S. Pat. Nos. 2,706,616; 2,847,655; 3,817,345; 4,245,313; 4,319,240; 4,117,895; 4,221,503; 3,667,556; 3,260,318 and U.S. patent application No. 541,821 filed Oct. 13, 1983, now U.S. Pat. No. 4,492,276.

SUMMARY OF THE INVENTION

The primary purpose of the present invention is to provide a method and apparatus for pipelaying in Arctic offshore waters, which method and apparatus are economical in use, and which do not subject construction equipment and personnel to many of the dangers associated with the Arctic offshore environment. Even more broadly, the present invention provides a method for drilling a deep, essentially horizontal, underground borehole which may be useful not only in Arctic, but in non-Arctic areas and which may find uses other than for pipelay. Accordingly, a method and apparatus are provided for drilling an underground borehole, which includes the steps and apparatus for forming the borehole; gripping the inside of the borehole with a tractor; and applying thrust from the tractor to propel drilling means forward. Preferably, at least one such tractor is employed adjacent the drilling means to apply thrust thereto. More preferably, sufficient numbers of tractors are installed at intervals along a drillstring (or pipeline) to overcome the friction between the drillstring (or pipeline) and the borehole, thus providing a net thrust to the entire drilling system. Each tractor may engage a drilling string and apply thrust to the drilling string which, in turn, applies thrust to the drilling means, or the tractor may engage a pipeline and apply thrust to the pipeline which, in turn, applies thrust to the drilling means. In a preferred embodiment, the invention includes inserting a pipeline into the borehole thusly formed. Preferably, the tractor is formed of at least two parts or elements which may be either simultaneously or sequentially advanced in the borehole. In the embodiment wherein the tractor parts are simultaneously advanced, the parts preferable are Archimedes screws which are rotated in opposite directions to grip the borehole. In the embodiment wherein the tractor parts are sequentially advanced, inflatable bladders may be used which are sequentially inflated to grip the borehole and then advanced, or the tractor parts may have trailing fingers which are sequentially extended to grip the borehole so that each part of the tractor can then be sequentially advanced.

Other purposes, distinctions over the art, advantages and features of the invention will be apparent to one skilled in the art upon review of the following.

DESCRIPTION OF PREFERRED EMBODIMENTS

The present invention provides a method and apparatus for installing offshore pipelines which minimizes or eliminates the hazards mentioned above in connection with offshore Arctic pipelaying. In accordance with the directional drilling technique of the present invention, it is possible to lay a pipeline in a deep underground arc, which may extend part or all the way between an offshore Arctic drilling location and an onshore site.

Advantages of the drilling method and apparatus of this invention for construction of Arctic pipelines include: (1) the pipeline is absolutely safe from ice gouging. (2) The pipeline is protected from most loss of soil support (permafrost conditions) by virtue of the arc-shaped pipeline geometry. (3) The pipeline in the directionally drilled borehole is not subject to damage from dredging or other industrial operations. (4) Permits are easier and faster to obtain because of lessened environmental impact. (5) Waterway traffic is not exposed to navigational hazards or interruptions. (6) The cost of moving vast amounts of earth is eliminated as well as restoration costs in areas where the pipeline goes ashore. (7) The pipeline is virtually maintenance-free. (8) Directional drilling can be done near existing pipelines and without interfering with shipping corridors. (9) Obstacles which may be avoided include difficult construction zones through heavy surf, sea bluffs, or unstable or heavily ice-encrusted shore areas, environmental, archeological, or recreational restrictions, man-made obstructions, and industrial and commercial areas. Any of these obstacles make above-ground right of way difficult to obtain and create hazardous working conditions.

Figure 1:
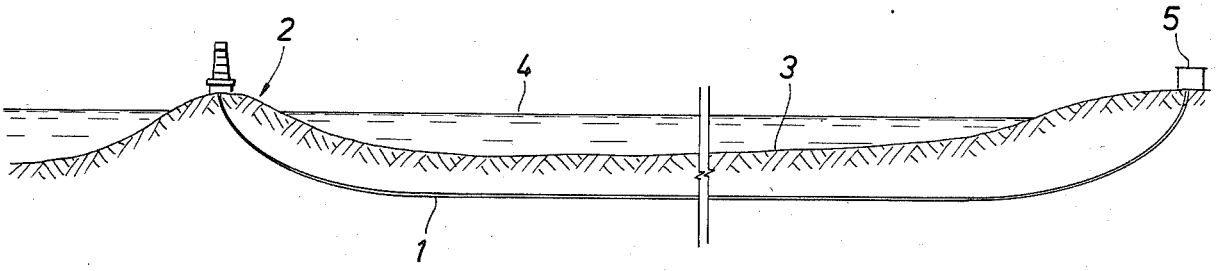
FIG. 1 depicts a pipeline laid in accordance with the present invention from an offshore island to an onshore site, or from an onshore site to an offshore island (the direction of pipelaying is immaterial).

As shown in FIG. 1 of the drawings, pipeline 1 preferably is laid in a deep underground arc. Also pipeline 1 may be laid as a series of deep underground arcs, each individual arc being significantly longer than those shown in applicant's copending application, Ser. No. 603,279 filed Apr. 24, 1984, now U.S. Pat. No. 4,553,879. Pipeline 1 may begin, for example, from a gravel island 2, with pipeline 1 extending downward below seabottom 3 well below the ice or waterline 4, then curving upwardly to an eventual shore crossing which passes under the shoreline to an onshore facility 5 for further processing or transfer of oil and/or gas. Alternatively, the pipeline construction could proceed in the opposite direction, from the onshore facilities to the offshore facility. Manifestly also, the invention may be useful for other locations than the offshore Arctic.

Figure 2:
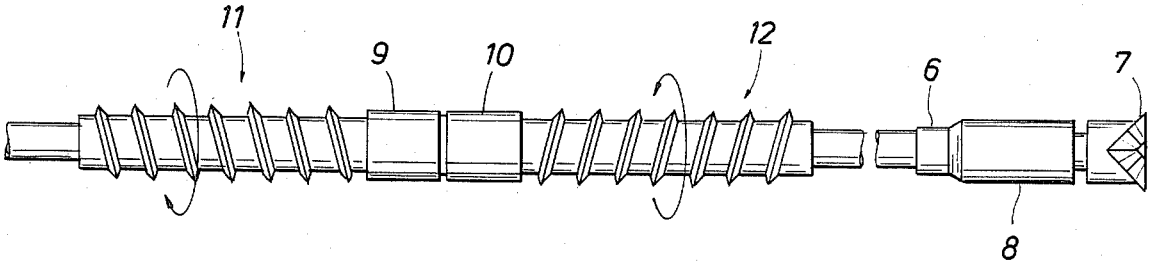
FIGS. 2 through 4 show species of apparatus for forming a borehole by long distance directional drilling.
Figure 3:
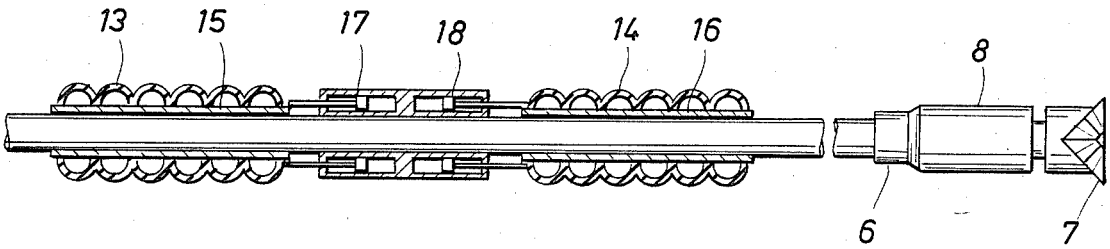
Figure 4:
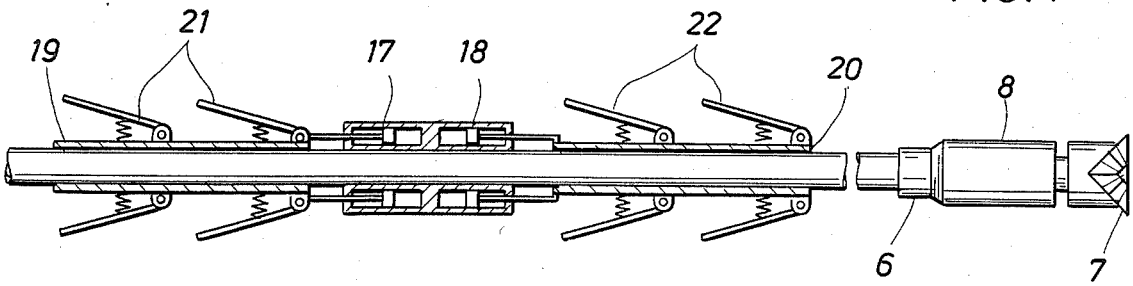

FIGS. 2 through 4 show various embodiments of the means for the long distance directional drilling of a borehole which would be suitable for the pipelay shown in FIG. 1. While the present invention is primarily directed to tractor means for providing thrust to a drilling bit, reference may be had to the above-identified application Ser. No. 541,821 for a motor and method for directional drilling of boreholes and also to downhole drilling motors as described in U.S. Pat. Nos. 3,667,556 and 3,260,318. The pipeline 1 (or drillstring) is attached to an actuator 6 as is well known in the art for controlling the direction of drilling operations. The drill bit 7, of a known type, is driven by a motor, such as a turbine motor 8, also of a known variety in the art. FIG. 2 shows one embodiment of tractor means for propelling drill bit 7 of this invention. In this embodiment hydraulic motors 9 and 10 are utilized to rotate two Archimedes screws 11 and 12, preferably in opposite directions, as shown by the direction of the arrows, in order to apply thrust to the drill bit 7. Hydraulic fluid to power the hydraulic motors 9 and 10, and the drill motor 8, and to flush away the drilling debris, is preferably carried through the pipeline 1 but may be carried by auxiliary pipelines either inside or outside of pipeline 1.

FIG. 3 shows another embodiment for applying thrust to the pipe and the drilling means, as necessary to form an essentially horizontal borehole suitable for a pipeline or other purpose. Two inflatable bladders 13, 14 mounted on slideable cylinders 15, 16 are alternately inflated, deflated, and translated longitudinally relative to the pipe by means of self-controlled hydraulic jacking mechanisms 17 and 18. Thus, by inflating one bladder to grip the inside of the borehole (not shown), and moving this bladder rearward, while at the same time deflating the other bladder and moving it forward, and then repeating this process for the opposite bladders, a stepwise forward thrust will be produced. Hydraulic fluid to inflate the bladders 13, 14, and to power the jacking mechanisms 17, 18, and to drive the drillmotor 8, etc., is preferably carried through the pipe 1 but may be carried by auxiliary pipelines, as mentioned above.

In FIG. 4, there is shown yet another embodiment of the tractor means. This embodiment utilizes hydraulic jacking mechanisms 17 and 18 similar to those shown in FIG. 3, but instead of inflatable bladders 9 and 10, there is employed slideable cylinders 19 and 20 having extendable fingers such as shown at 21 and 22. The extendable fingers 21 and 22 are alternately extended to engage the borehole walls (not shown) as each cylinder is alternately oscillated backward and forward to advance pipeline 1 by means of the hydraulic jacking mechanisms 17 and 18. The rearward-pointing fingers 21, 22 may be spring-loaded to passively engage the borehole (not shown) throughout the moveup process, and therefore would not require active control as for an inflatable bladder. Hydraulic fluid for the hydraulic jacking mechanisms may be provided in the manner as for the embodiment of FIG. 3.

The foregoing description of the invention is merely intended to be explanatory thereof, and various changes in the details of the described method and apparatus may be made within the scope of the appended claims without departing from the spirit of the invention.

What is claimed is:

1. A method for laying a pipeline beneath a seabottom subject to ice gouging, comprising:

forming a borehole with drilling means;

gripping the inside of the borehole with at least one tractor;

applying thrust from said at least one tractor to propel the drilling means forward until a deep arcuate borehole is formed beneath the seabottom sufficiently deep to avoid ice gouging and inserting a pipeline into the borehole.

2. The method of claim 1 wherein the tractor engages a drilling string, and the tractor applies thrust to the drilling string which in turn applies thrust to the drilling means.

3. The method of claim 1 wherein the tractor engages the pipeline, and the tractor applies thrust to the pipeline which in turn applies thrust to the drilling means.

4. The method of claim 1 wherein multiple tractors are employed at equally spaced intervals along the drilling string in order to overcome the friction of the drilling string inside the borehole as well as to apply thrust to the drilling means.

5. The method of claim 1 wherein a series of deep underground arcs are formed between the offshore island and the onshore site.

6. The method of claim 1 wherein the drilling means and a drill string are withdrawn from the borehole before inserting the pipeline into the borehole.

7. The method of claim 5 wherein the pipeline is drawn into the borehole by said at least one tractor.

8. The method of claim 1 wherein said at least one tractor comprises at least two parts which are simultaneously advanced in the borehole.

9. The method of claim 8 wherein said at least one tractor comprises at least two Archimedes screws which are rotated in opposite directions to grip the borehole.

10. The method of claim 1 wherein said at least one tractor comprises at least two parts which are sequentially advanced in the borehole.

11. The method of claim 10 wherein said at least one tractor comprises slideable cylinders having inflatable bladders which are sequentially inflated to grip the borehole and then advanced.

12. The method of claim 10 wherein said at least one tractor comprises slideable cylinders having fingers which are sequentially extended to grip the borehole and then advanced.

13. The method of claim 12 wherein the fingers point rearward and are spring-loaded to passively engage the borehole.

* * * * *